US008162170B1

(12) United States Patent
Massad

(10) Patent No.: US 8,162,170 B1
(45) Date of Patent: Apr. 24, 2012

(54) TIP RESISTANT BEVERAGE CONTAINER PROVIDING A TIP LIP

(76) Inventor: Gary L. Massad, Oklahoma City, OK (US)

( * ) Notice: Subject to any disclaimer, the term of this patent is extended or adjusted under 35 U.S.C. 154(b) by 1218 days.

(21) Appl. No.: 11/406,613

(22) Filed: Apr. 19, 2006

Related U.S. Application Data

(60) Provisional application No. 60/672,714, filed on Apr. 19, 2005.

(51) Int. Cl.

| | |
|---|---|
| ***B65D 25/20*** | (2006.01) |
| ***B65D 81/38*** | (2006.01) |
| ***A47J 41/00*** | (2006.01) |
| ***F25D 3/08*** | (2006.01) |

(52) U.S. Cl. ..... 220/739; 220/592.17; 220/630; 248/311.2; 248/346.11; 62/457.4

(58) Field of Classification Search ..... 220/603, 220/729, 571, 571.1, 625, 626, 628, 630–632, 220/636, 731, DIG. 5, 737, 739; 248/346.11, 248/311.2; 62/457.4

See application file for complete search history.

(56) References Cited

U.S. PATENT DOCUMENTS

| | | | | | |
|---|---|---|---|---|---|
| 62,949 | A | | 3/1867 | Farley | |
| 821,208 | A | * | 5/1906 | Voss | 248/346.11 |
| 937,850 | A | * | 10/1909 | Parker | 81/3.09 |
| 1,300,867 | A | | 4/1919 | Pick | |
| 1,338,106 | A | * | 4/1920 | Smith | 248/128 |
| 2,041,563 | A | * | 5/1936 | Meinecke | 215/227 |
| D133,703 | S | * | 9/1942 | Parker | D7/505 |
| 2,587,237 | A | | 7/1949 | Sinaiko | |
| 2,591,374 | A | | 4/1952 | Place | |
| 2,601,767 | A | * | 7/1952 | Wall | 220/719 |
| 2,784,577 | A | * | 3/1957 | Beaham | 248/146 |
| 2,799,147 | A | * | 7/1957 | Crawford, Jr. | 220/23.83 |
| 2,856,095 | A | * | 10/1958 | Schnabel | 220/571.1 |
| 2,885,108 | A | * | 5/1959 | Donoghue | 220/798 |
| 2,936,926 | A | * | 5/1960 | Miller | 220/571 |
| 2,937,872 | A | * | 5/1960 | Gilman | 473/444 |
| 2,968,888 | A | * | 1/1961 | Borah | 248/346.11 |
| 2,997,199 | A | * | 8/1961 | Reachi | 220/23.86 |
| 3,010,602 | A | * | 11/1961 | Randolph | 220/567.3 |
| 3,013,688 | A | * | 12/1961 | Luning | 215/376 |
| 3,028,702 | A | * | 4/1962 | St Cyr | 215/395 |
| 3,079,037 | A | * | 2/1963 | Schechter | 220/212 |
| 3,120,077 | A | * | 2/1964 | Stoffel | 248/346.11 |
| 3,246,786 | A | * | 4/1966 | Holley | 215/393 |
| 3,302,428 | A | * | 2/1967 | Paquin et al. | 62/457.4 |
| 3,393,892 | A | * | 7/1968 | Buck | 248/346.11 |
| 3,524,614 | A | * | 8/1970 | Sorth | 248/131 |
| 3,543,287 | A | * | 11/1970 | Henkel | 220/698 |

(Continued)

*Primary Examiner* — J. Gregory Pickett
*Assistant Examiner* — Ned A Walker
(74) *Attorney, Agent, or Firm* — Daniel P. Dooley; Hall Estill

(57) ABSTRACT

A beverage container that includes at least a bottom portion with a side portion extending from the bottom portion, and a balance mass in pressing engagement with the bottom portion is disclosed. The balance mass is adjacent an inner surface of the bottom portion in a preferred embodiment, and adjacent an outer surface in an alternate preferred embodiment. In each embodiment, the balance mass includes at least a core portion encapsulated by an encapsulant, in which the density of the core is greater than the density of a beverage of the beverage container. In the alternate preferred embodiment, the balance mass further includes a tip lip portion with a condensate retention ridge, and a condensate aperture. The condensate retention ridge, in cooperation with a side portion of the balance mass, forms a condensate channel, and the condensate aperture drains condensate from the condensate channel.

12 Claims, 5 Drawing Sheets

U.S. PATENT DOCUMENTS 3,606,074 A * 9/1971 Hayes ..... 220/212
3,744,671 A * 7/1973 Saunders, Jr. ..... 220/698
3,762,591 A * 10/1973 Gray ..... 215/393
3,808,084 A * 4/1974 Doty ..... 248/346.11
3,831,209 A * 8/1974 Clingman ..... 441/136
3,966,077 A * 6/1976 Jardine ..... 220/603
4,040,549 A * 8/1977 Sadler ..... 224/483
4,055,273 A * 10/1977 Jones ..... 220/631
4,089,498 A * 5/1978 Woodruff ..... 248/346.11
4,096,966 A * 6/1978 Korshak ..... 220/603
4,127,211 A * 11/1978 Zerbey ..... 220/212
4,157,707 A * 6/1979 Schwind et al. ..... 126/386.1
4,303,170 A * 12/1981 Panicci ..... 220/603
4,383,422 A * 5/1983 Gordon et al. ..... 62/457.4
4,388,996 A * 6/1983 Panicci ..... 220/603
4,591,066 A 5/1986 Moen
4,699,282 A * 10/1987 Farrar ..... 206/459.5
D293,642 S * 1/1988 Rubbright et al. ..... D7/605
4,733,790 A * 3/1988 Stein ..... 220/23.83
4,745,776 A * 5/1988 Clark ..... 62/457.4
4,756,497 A * 7/1988 Lan ..... 248/205.9
4,759,524 A * 7/1988 Anderson ..... 248/346.11
4,829,618 A * 5/1989 McKee ..... 7/151
4,836,488 A * 6/1989 Ross ..... 248/346.11
4,858,872 A * 8/1989 Witt ..... 248/346.11
4,892,215 A * 1/1990 Carlson et al. ..... 220/610
4,928,848 A * 5/1990 Ballway ..... 220/23.87
4,964,527 A * 10/1990 Martin ..... 220/698
4,989,415 A * 2/1991 Lombness ..... 62/372
5,052,582 A * 10/1991 Hall ..... 220/571
5,088,948 A 2/1992 Scheurer
5,150,869 A * 9/1992 Gould et al. ..... 248/346.11
5,180,077 A * 1/1993 Lewis ..... 220/592.2
5,212,963 A * 5/1993 McGinnis ..... 62/457.4
5,273,182 A * 12/1993 Laybourne ..... 220/740
5,294,018 A 3/1994 Boucher
5,312,013 A * 5/1994 Bridges ..... 220/625
5,465,891 A * 11/1995 Bridges ..... 224/566
5,481,823 A * 1/1996 Hoover et al. ..... 43/55
5,601,744 A * 2/1997 Baldwin ..... 219/689
5,653,124 A * 8/1997 Weber ..... 62/457.4
5,669,538 A * 9/1997 Ward ..... 224/539
5,727,709 A 3/1998 Nobile
5,842,675 A * 12/1998 Davitt ..... 248/346.5
5,845,499 A * 12/1998 Montesanto ..... 62/48.1
5,904,267 A * 5/1999 Thompson ..... 220/592.16
5,975,333 A * 11/1999 Lee ..... 220/571
5,984,156 A * 11/1999 Bridges ..... 224/566
6,089,519 A * 7/2000 Laybourne ..... 248/346.11
6,101,838 A * 8/2000 Teague ..... 62/457.4
6,168,034 B1 1/2001 Perrone
6,305,656 B1 * 10/2001 Wemyss ..... 248/309.4
6,530,496 B2 3/2003 Moran
6,612,943 B2 * 9/2003 Beers ..... 473/451
6,640,992 B1 * 11/2003 Berger et al. ..... 220/603
6,764,622 B2 7/2004 Moran
6,786,062 B1 * 9/2004 Greenberg ..... 62/457.4
6,793,094 B2 9/2004 Turnbough
6,796,430 B2 * 9/2004 Mercier et al. ..... 206/505
7,097,069 B2 * 8/2006 Cavanagh ..... 221/312 R
7,124,604 B2 * 10/2006 Taylor et al. ..... 62/457.4
7,712,625 B2 * 5/2010 Alger ..... 220/737
7,770,410 B2 * 8/2010 Cote ..... 62/457.4
2002/0092855 A1 7/2002 Moran
2002/0134903 A1 * 9/2002 Lin ..... 248/346.11
2004/0040968 A1 * 3/2004 Visser ..... 220/560
2004/0074910 A1 4/2004 Fripps
2004/0195250 A1 10/2004 Fripps
2006/0091141 A1 * 5/2006 Scott ..... 220/560

* cited by examiner

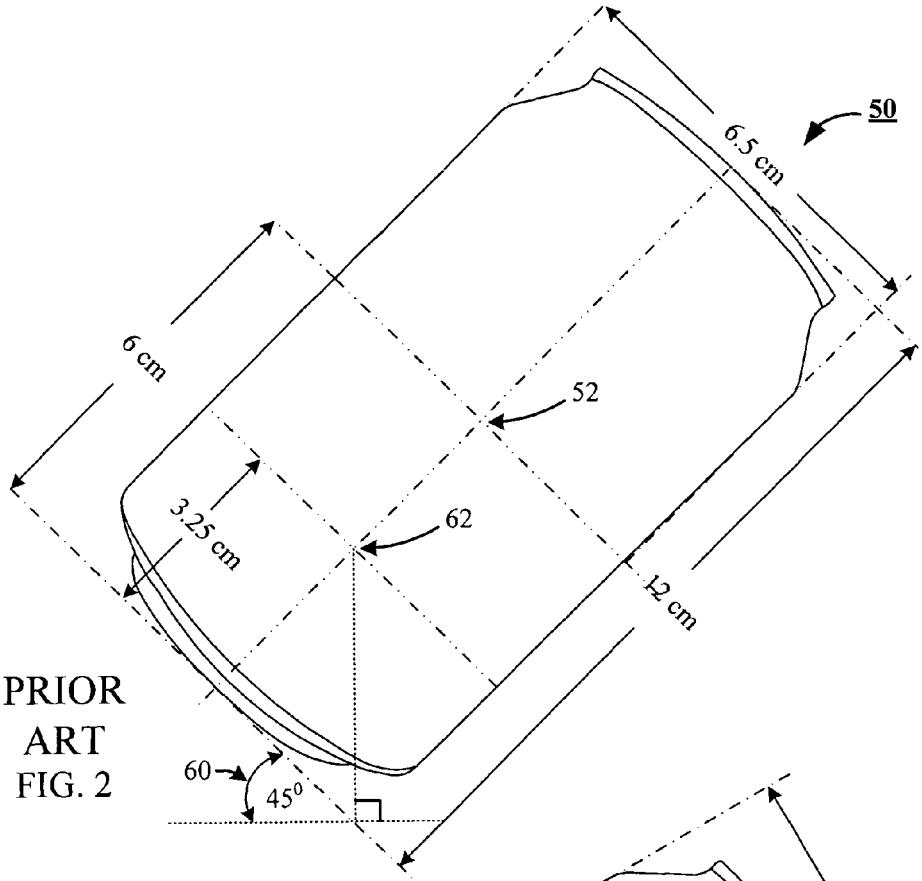
PRIOR ART FIG. 2
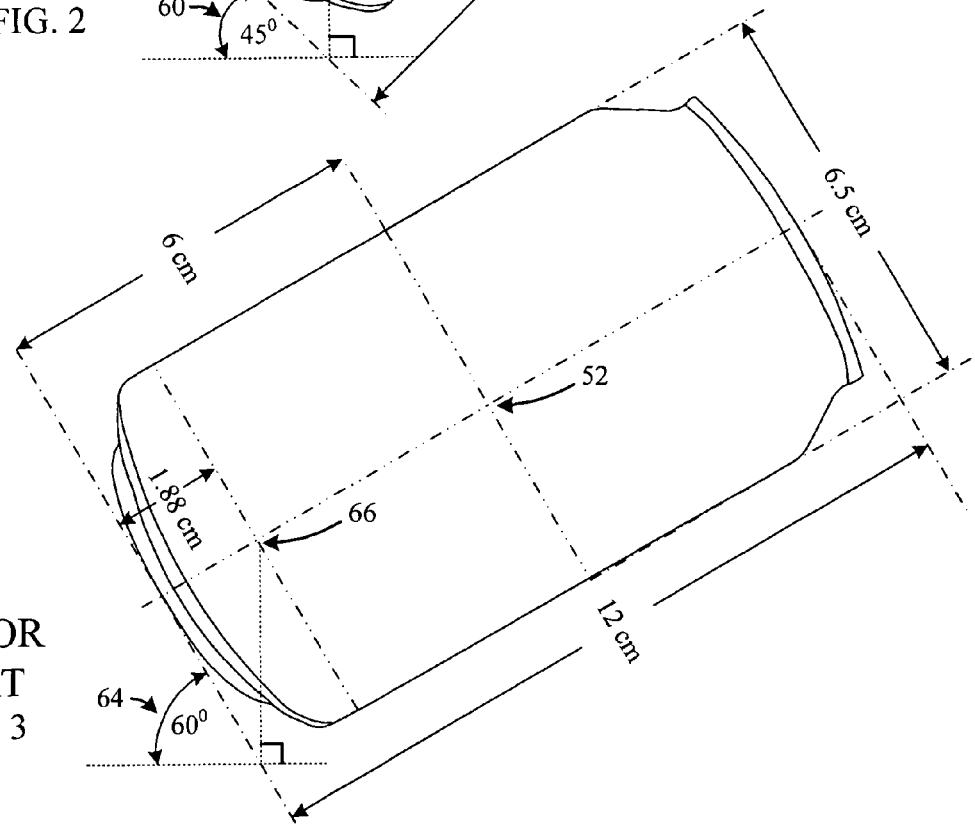
PRIOR ART FIG. 3

TIP RESISTANT BEVERAGE CONTAINER PROVIDING A TIP LIP

RELATED APPLICATIONS

The present application claims priority to U.S. Provisional Application No. 60/672,714 filed Apr. 19, 2005, entitled Tip Resistant Beverage Container.

BACKGROUND OF THE INVENTION

1. Field of the Invention

The present invention relates to beverage containers. More particularly, but not by way of limitation, the present invention relates to beverage containers that resist an inadvertent toppling over of the beverage container.

2. Background of the Invention

Brewed beverages and soft drinks have been packaged in containers, such as metallic cans, for multiple decades, and problems with an inadvertent toppling over of the container have been common for the same period. Automobile makers have addressed the problem by including beverage holders in their vehicles. Parents have attempted to address the problem by serving their toddlers soft drinks in a tip resistant cup, that frequently include a lid that meters a limited amount of fluid over a given time. Although generally effective, at times the lid portion gets separated from the cup portion, a soft drink is served in the cup portion, and the soft drink ends up on the carpet. As such, challenges remain and a need persists for improvements in integrating tip resistant technology into direct relationship with beverage containers, and it is to these needs and challenges that the present invention is directed.

SUMMARY OF THE INVENTION

In accordance with a preferred embodiment, a beverage container that includes at least a bottom portion with a side portion extending from the bottom portion, and a balance mass in pressing engagement with the bottom portion is provided. Preferably, the bottom portion includes at least an inner surface and an outer surface, and in a preferred embodiment, the balance mass is adjacent the inner surface of the bottom portion.

In an alternate preferred embodiment, the balance mass is adjacent the outer surface of the bottom portion. In each embodiment, the balance mass includes at least a core portion encapsulated by an encapsulant, in which the density of the core is greater than the density of a beverage of the beverage container. In the alternate preferred embodiment, the balance mass further includes a tip lip portion with a condensate retention ridge, and a condensate aperture. The condensate retention ridge in cooperation with a side portion of the balance mass forms a condensate channel, and the condensate aperture drains condensate from the condensate channel.

The beverage container of the preferred embodiment, the encapsulant further features a side surface, a top surface adjacent the side surface, and a bottom surface separated from the top surface by the side surface. Preferably, the side surface provides a serration, wherein the serration is adjacent the interior wall of the side portion of the beverage container, and the bottom surface conforms to the inner surface of the bottom portion.

These and various other features and advantages which characterize the claimed invention will be apparent from reading the following detailed description and a review of the associated drawings.

BRIEF DESCRIPTION OF THE DRAWINGS

FIG. 2 provides an elevational view of the beverage container of FIG. 1 tilted at a first spill angle.

FIG. 3 illustrates an elevational view of the beverage container of FIG. 1 tilted at a second spill angle.

DESCRIPTION OF THE PREFERRED EMBODIMENTS

Before explaining the present invention in detail, it is important to understand that the invention is not limited in its application to the details of the construction illustrated, or by the steps of construction inherently present by way of illustration of the appended drawings. The invention is capable of other embodiments and of being practiced or carried out in a variety of ways. It is to be understood that the phraseology and terminology employed herein is for the purpose of description and does not impose limitation on the present invention.

Figure 1:
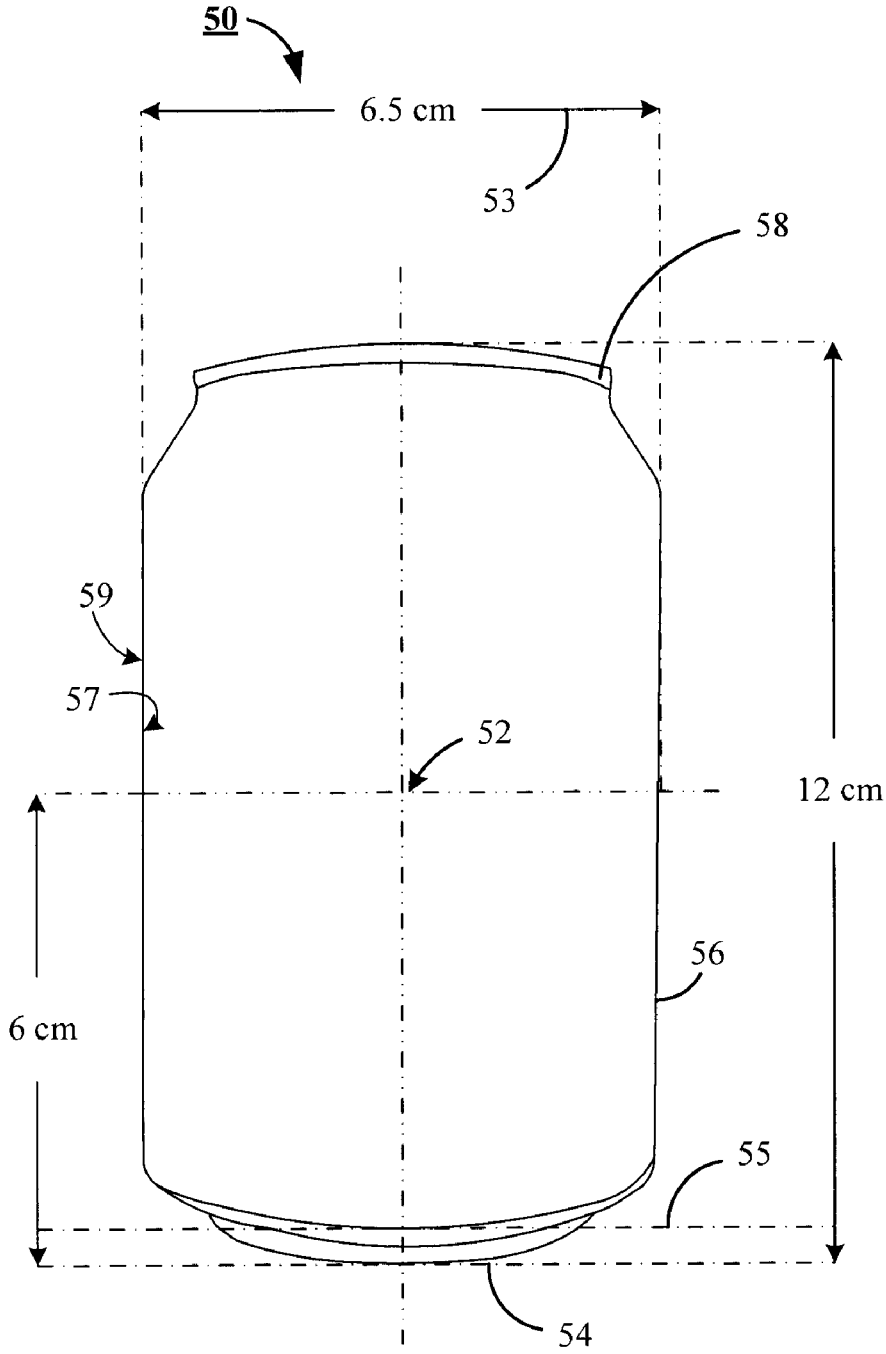
PRIOR ART FIG. 1
FIG. 1 shows an elevational view of a prior art beverage container.

Referring now to the drawings, and in particular to an example of a prior art beverage container 50 as shown in FIG. 1. Not by way of limitation, but by way of illustration only, the prior art beverage container 50 provides exemplary dimensions for use in describing changes in position of a center of mass 52 of a mass of substantially 340.2 grams (g). As shown by FIG. 1, the prior art beverage container 50 includes a bottom portion 54, a side portion 56 protruding from the bottom portion 54, wherein the side portion 56 provides a fixed diameter 53, and a lid portion 58 offset from the bottom portion 54 by the side portion 56. In an upright position, as shown by FIG. 1, and referencing the dimensions shown by FIG. 1 for the prior art beverage container 50, the center of mass 52 is located midway between the bottom portion 54 and the lid portion 58, and at the center point of a cylinder defined by the side portion 56, i.e., at substantially 6 cm away from the bottom portion 54 and set in substantially 3.25 cm from the side portion 56. FIG. 1 further shows the side portion 56 includes an interior wall 57 and a corresponding exterior wall 59 above a transition region 55. That is to say, the bottom portion 54 extends from the transition region 55 in a direction away from the lid portion 58, wherein the transition region is defined to be where the cylindrical side portion 56 transitions into an inward sloping conical section near the bottom of container 50.

Turning to FIG. 2, shown therein is a spill angle 60 of substantially 45 degrees, which is an angle at which the prior art beverage container 50 will overturn unless a change in the center of mass 52 of the prior art beverage container 50 occurs. That is, to keep the prior art beverage container 50 from overturning, the center of mass 52 must be moved from the center of mass 52 to a new center of mass 62. When the center of mass is moved from the center of mass 52 to a new center of mass 62, 72.92% of the original mass of the beverage contained within the prior art beverage container 50 is above the new center of mass 62.

To maintain a balance condition, i.e., to avert a tumbling over of the prior art beverage container 50, a mass substantially equal to 72.92% of the original mass of the beverage contained within the prior art beverage container 50 will need to be below the new center of mass 62. That is to say, the composite density of the material below the new center of mass 62 would need to be substantially 2.7 times the density of the beverage contained within the prior art beverage container 50. Because the prior art beverage container 50 has no such change in material density, the prior art beverage container 50 will overturn at a spill angle of substantially 45 degrees.

FIG. 3 shows a spill angle 64 of substantially 60 degrees. To maintain a balance condition, i.e., to avert a tumbling over of the prior art beverage container 50, a mass substantially equal to 84.42% of the original mass of the beverage contained within the prior art beverage container 50 will need to be below a new center of mass 66. That is to say, the composite density of the material below the new center of mass 66 would need to be substantially 5.44 times the density of the beverage contained within the prior art beverage container 50. Because the prior art beverage container 50 has no such change in material density, the prior art beverage container 50 will overturn at a spill angle of substantially 60 degrees.

Figure 4:
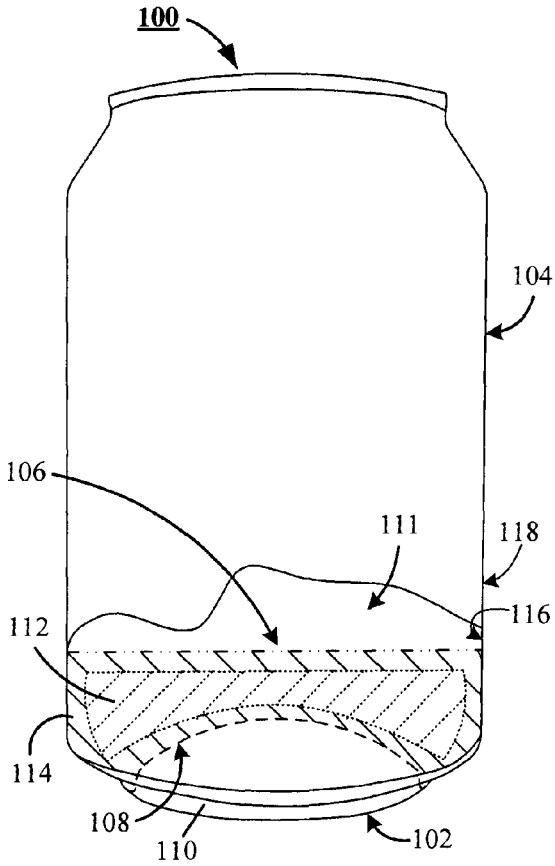
FIG. 4 illustrates an elevational, partial cutaway, partial cross-sectional, and partial hidden view of an inventive beverage container of the present invention.

Referring now to FIG. 4, and in particular to an inventive tip resistant beverage container "container" 100 shown therein. Not by way of limitation, but by way of illustration only, in a preferred embodiment the container 100 is particularly useful as a container for canned beverages, and includes at least a bottom portion 102 supporting a side portion 104, which extends from the bottom portion 102, and a balance mass 106 in pressing engagement with the bottom portion 102. Preferably, the bottom portion 102 further provides an inner surface 108 and an outer surface 110, wherein the balance mass 106 is in pressing engagement with the inner surface 108.

The balance mass 106 preferably includes at least a core portion 112 encapsulated by an encapsulant 114. The encapsulant 114 is preferably formed from a polymer approved by the Federal Food and Drug Administration for use in confining foodstuffs. The composition of the core portion 112 is a function of a number of degrees of spill angle the container 100 can undergo and still recover to an upright position. As the spill angle from which the container 100 is to recover increases, an amount of volume within the container 100 allocated for use in housing the balance mass 106 decreases. A decreasing volume within the container 100 allocated for use in housing the balance mass 106 necessitates an increased density differential between the mass of the beverage contained by the container 100 and the mass of the core portion 112. That is, the density of the core portion 112 becomes a multiple of the density of the beverage contained by the container 100.

For example, and not by way of limitation, if a beverage 111 (also referred to herein as fluid 111) contained within the container 100 (with substantially identical dimensions to the prior art beverage container 50 of FIG. 3) has a mass of 280.20 grams and occupies 84.42% of the available volume of the container 100 (leaving 15.58% of the available volume for occupancy by the balance mass 106), and a desired spill angle is 60°, then the density of the balance mass 106 would be substantially 5.44 times the density of the beverage contained within the container 100. To maintain the container 100 in a balanced state at a 60° spill angle, the mass above a center of mass must be substantially equal to the mass below the center of mass (which in this case, the center of mass of the container 100 would be substantially identical to the center of mass 66 of the prior art beverage container 50 of FIG. 3).

Letting: V represent the available volume of the container 100; $M_1$ represent the mass above the center of gravity; $M_2$ represent the mass below the center of gravity; $D_1$ represent the density of the beverage; and $D_2$ represent the combined density of the balance mass 106, the following relationships hold:

$$M_1=M_2$$

$$D_1=M_1/(0.8442*V)$$

$$D_2=M_2/(0.1558*V)$$

$$M_1=D_1*(0.8442*V)$$

$$M_2=D_2*(0.1558*V)$$

$$D_1*(0.8442*V)=D_2*(0.1558*V)$$

$$D_1*(0.8442)=D_2*(0.1558)$$

$$D_2=D_1*(0.8442)/(0.1558)$$

$$D_2=5.44D_1$$

At a spill angle of 45°, the center of mass of the container 100 would be substantially identical to the center of mass 62 of the prior art beverage container 50 of FIG. 2, and the following relationship would hold:

$$M_1=M_2$$

$$M_1=D_1*(0.7292*V)$$

$$M_2=[D_1*(0.1150*V)]+[D_2*(0.1558*V)]$$

$$D_1V*[0.7292-0.1150]=D_2V*[0.1558]$$

$$D_1*[(0.6142)/(0.1558)]=D_2$$

$$D_2=3.88D_1$$

By the above example, one skilled in the art will recognize that the mass of the core portion 112 is directly proportional to spill angle. That is, the greater the number of degrees of spill angle present, the greater must be the mass of the core portion 112 to maintain the container 100 in a balanced state while encountering the spill angle.

Figure 5:
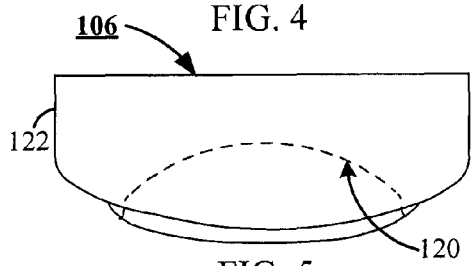
FIG. 5 provides an elevational and partial hidden view of a balance mass of the inventive beverage container of FIG. 4.

FIG. 4 further shows the side portion 104 includes an interior wall 116 and an exterior wall 118, while FIG. 5 shows the balance mass 106 is configured to conform to the inner surface 108 of the bottom portion 102 (of FIG. 4). Preferably, when the balance mass 106 is positioned within the container 100 (of FIG. 4), a bottom surface 120 of the balance mass 106 is in substantially continuous and pressing engagement with the inner surface 108 of the bottom portion 102. FIG. 5 further shows the balance mass 106 provides a side surface 122 that preferably is in pressing engagement with the interior wall 116 of the side portion 104 (of FIG. 4) when the bottom surface 120 of the balance mass 106 is in pressing engagement with the inner surface 108 of the bottom portion 102.

Figure 6:
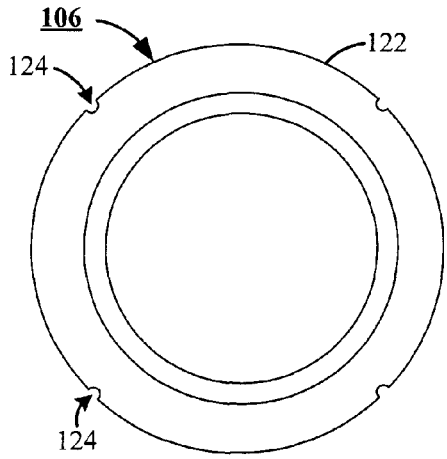
FIG. 6 shows a bottom plan view of the balance mass of FIG. 5.

FIG. 6 shows the side surface 122 provides a serration 124. In a preferred process, the serration 124 permits air to escape from between the bottom surface 120 of the balance mass 106 (of FIG. 4), and the inner surface 108 of the bottom portion 102 (of FIG. 4), while the bottom surface 120 (of FIG. 5) is being placed into pressing engagement with the inner surface 108.

Figure 7:
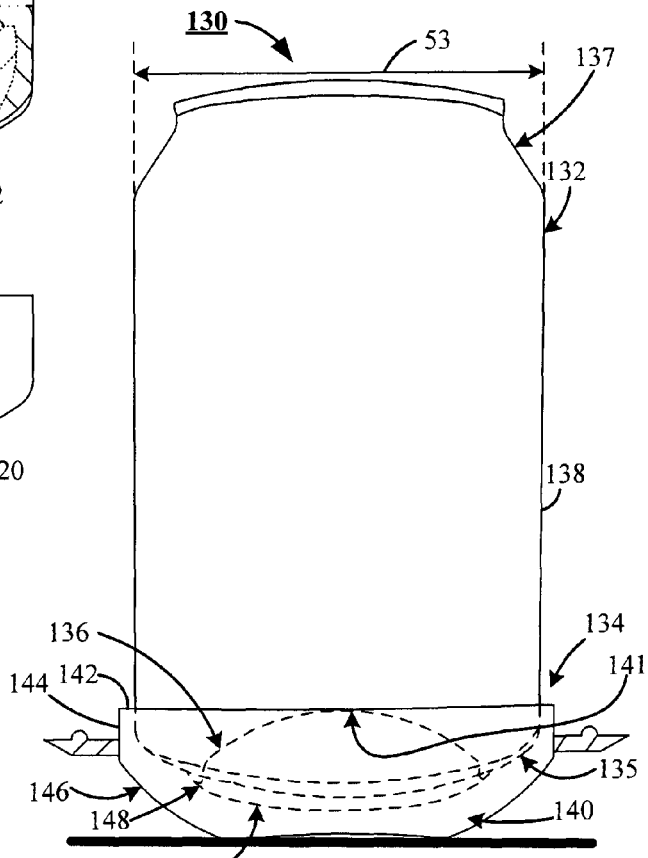
FIG. 7 shows an elevational, partial hidden line view of an alternate embodiment of the inventive beverage container of the present invention.

FIG. 7 shows an alternate embodiment of the present invention; an alternate container 130. The alternate container 130 includes at least a beverage container 132, and a balance mass 134. The beverage container 132 preferably includes a bottom portion 136 (shown in hidden line form), with a side portion 138 extending from the bottom portion 136. The balance mass 134 preferably includes an encapsulant 140. The encapsulant 140 preferably includes at least a top surface 142 adjacent a side surface 144, and a bottom surface 146 separated from the top surface 142 by the side surface 144, wherein the top surface 142 conforms to an outer surface 148 of the bottom portion 136. FIG. 7 further shows, the side portion 138 extends from a transition region 135 toward a lip region 137 of the beverage container 132, while the bottom portion 136 commences at the transition region 135 and extends from the transition region 135 in a direction away from the lip region 137 culminating at an interface surface 139 of the beverage container 132. It is noted that the transition region is defined to be where the side portion 138 transitions from a cylindrical shape, shown by FIG. 7, into an inward sloping conical section near the bottom of container 132. The rounded section, that portion of the container 132 where the side portion 138 with its cylindrical shape transitions into an inward sloping conical section near the bottom of container 132, forms a part of the bottom portion 136. The bottom portion further includes a concave area 141 commencing at the interface surface 139 and protruding toward the lip region 137. The side portion 138 commences at the transition region 135, culminates at the lip region 137 and preferably presents a fixed diameter 55 (of FIG. 1) along its entire length, which means that a cross-sectional area of the beverage container 132 taken at any point along the side portion 138 is the same as the cross-sectional area taken along any other point along the side portion 138.

Figure 8:
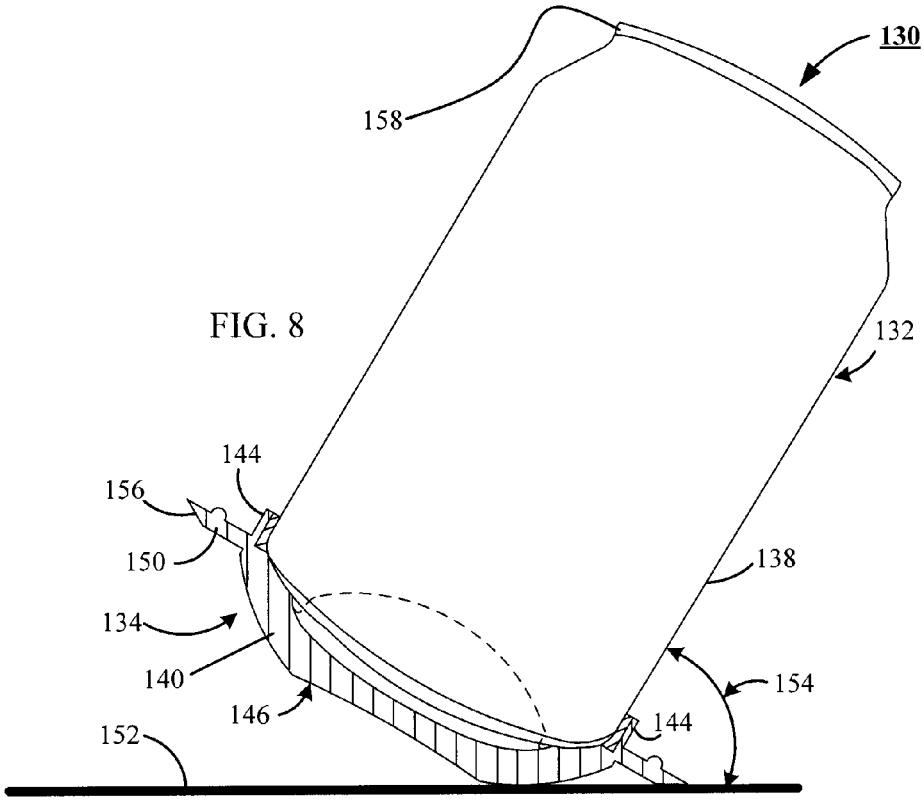
FIG. 8 provides an elevational view of the inventive beverage container of FIG. 7 tilted at a first spill angle.

FIG. 8 shows the encapsulant 140 further preferably includes a tip lip portion 150 extending radially from the side surface 144, wherein the tip lip portion 150 mitigates an inadvertent engagement of the side portion 138 with a container support surface 152 supporting the bottom surface 146. Further shown by FIG. 8 is a spill angle 154 defined as an angle between the side portion 138 and the container support surface 152, wherein upon encountering an angle greater than the spill angle 154, the side portion 138 contacts the container support surface 152.

The tip lip portion 150 further includes at least a tip engagement surface 156 on a distal portion of the tip lip portion 150, wherein upon encountering a tipping force sufficient to engender an angle between the side portion 138 and the container support surface 152 greater than the spill angle 154, the tip engagement surface 156 engages the container support surface 152 to preclude contacting engagement of the side portion 138 with the container support surface 152, and the balance mass 134 returns the side portion 138 to an upright position relative to the container support surface 152.

FIG. 8 further shows that the beverage container 132, preferably further includes a lid portion 158 offset from the bottom portion 136 by the side portion 138.

Preferably, the side portion 138 has a predetermined overall length, and the tip lip portion 150 is offset from the lid portion 158 by a predetermined portion of the predetermined overall length of the side portion 138. At each predetermined portion of offset, the tip lip portion 150 forms a member of specific width, wherein each predetermined portion of offset is directly proportional to a mass of a core 160 (of FIG. 9), and wherein each specific width of the tip lip portion 150 associated with each predetermined portion of offset of the tip lip portion 150 from the lid portion 158 is indirectly proportional to the mass of the core 160. In other words, as the mass of the core 160 increases, the amount of offset of the tip lip portion 150 from the lid portion 158 increases, and as the mass of the core 160 increases, the width of the tip lip portion 150 decreases.

Figure 9:
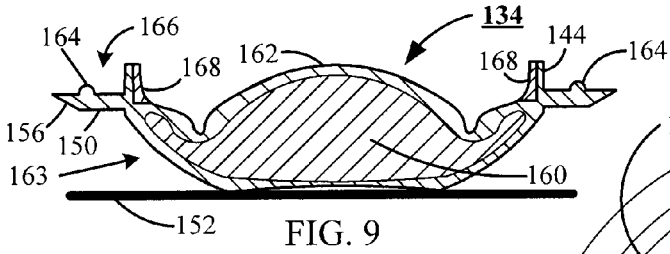
FIG. 9 illustrates an elevational cross-sectional view of a balance mass of the inventive beverage container of FIG. 7.

In addition to the core 160 of the balance mass 134, FIG. 9 further shows an encapsulant wall 162 enclosing the core 160, a condensate retention ridge 164 provided by the tip lip portion 150, a condensate channel 166 formed between the condensate retention ridge 164 and the side surface 144, and a friction portion 168 supported by the side surface 144, and wherein the encapsulant wall 162 directly contacting the core 160 forms a base region 163 of the balance mass 134, the base region 163, is in contacting adjacency with the container support surface 152. The encapsulant wall 162 is preferably formed from a polymer approved by the Federal Food and Drug Administration for use in confining foodstuffs, but may be formed from any ridged or semi-ridged material. The condensate retention ridge 164 confines condensate within the condensate channel 166 to preclude water marks on the container support surface 152 (of FIG. 8), and the friction portion 168 is preferably formed from a deformable polymer, such as polyurethane, which deforms an amount sufficient to impart a force against the side portion 138 of the beverage container 132 (of FIG. 8), to avert an unintentional dislodgement of the balance mass 134 from the beverage container 132.

Figure 10:
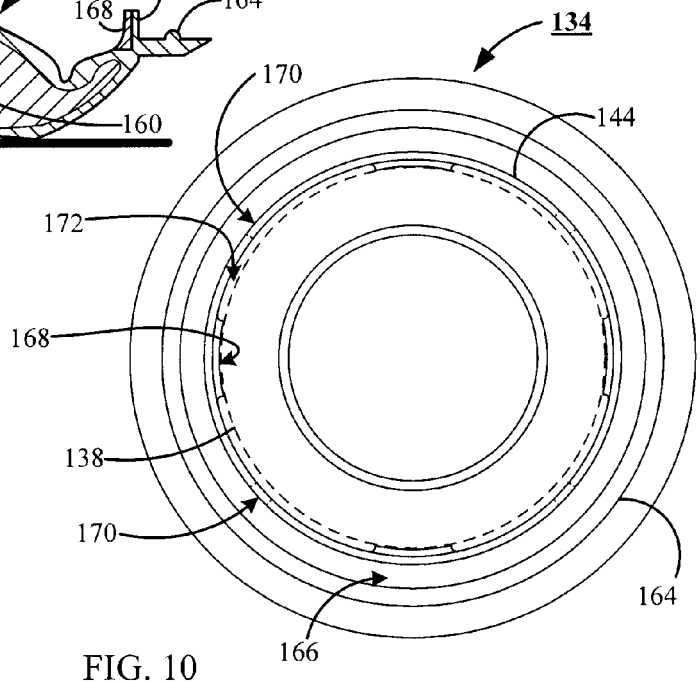
FIG. 10 provides a top plan view of the balance mass of FIG. 9.

FIG. 10 shows the balance mass 134 further includes a plurality of condensate apertures 170 extending from the condensate channel 166 and through the side surface 144. FIG. 10 further shows that the friction portions 168 are preferably distributed in various locals around the side surface 144. By distributing the friction portions 168 at various locals around the side surface 144, condensate collection cavities 172 are formed between the side portion 138 (shown by dashed lines) of the beverage container 132 (of FIG. 8), the side surface 144, and the friction portions 168. Preferably, the condensate apertures 170 extending from the condensate channel 166 and through the side surface 144 are aligned with the condensate collection cavities 172 to allow condensate collected in the condensate channel 166 to drain into the condensate collection cavities 172.

Figure 12:
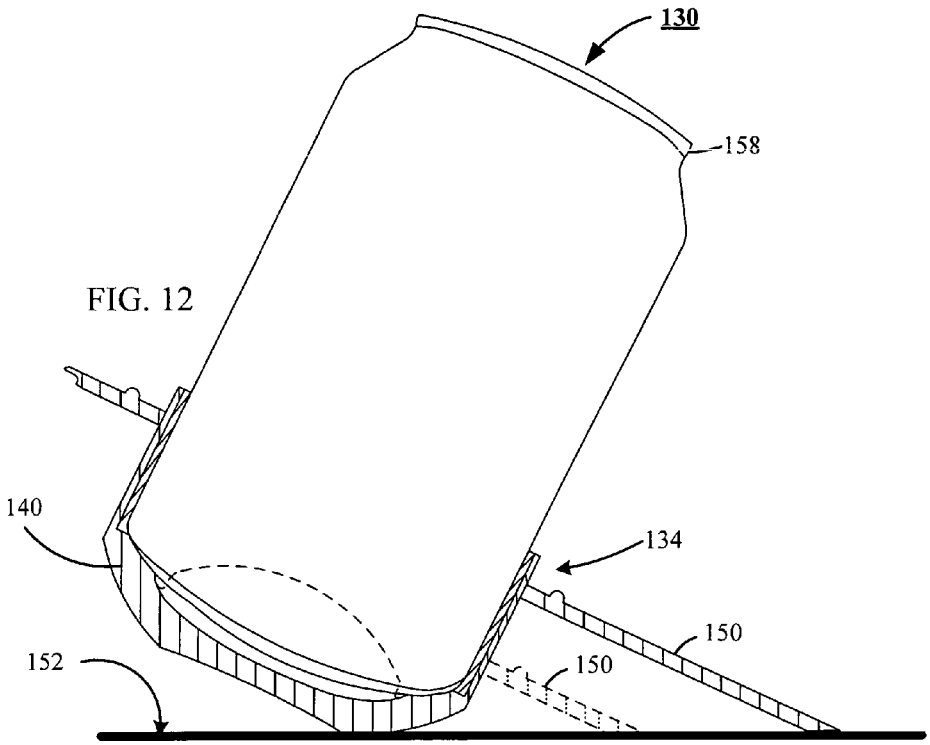
FIG. 12 illustrates a plan view of the balance mass of FIG. 11.
Figure 11:
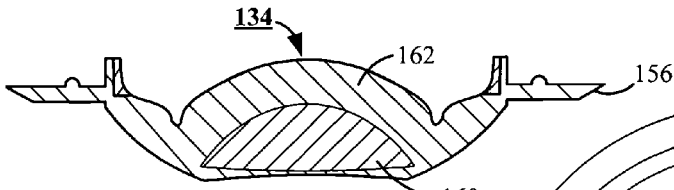
FIG. 11 provides an elevational view of the inventive beverage container of FIG. 7 tilted at a second spill angle.

Continuing with FIGS. 11 and 12, the embodiment shown therein is illustrative of an effect of reducing the mass of the core 160 of the balance mass 134. To assure the beverage container 132 is capable of returning to an upright position relative to the container support surface 152 when the mass of the core 160 is reduced, either the offset of the balance mass 134 from the lid portion 158 needs to be reduced and the width of the tip lip portion 150 needs to be increased, or the width of the tip lip portion 150 needs to be increased, relative to the width of the tip lip portion 150 of FIG. 9, as shown by FIG. 11.

Figure 13:
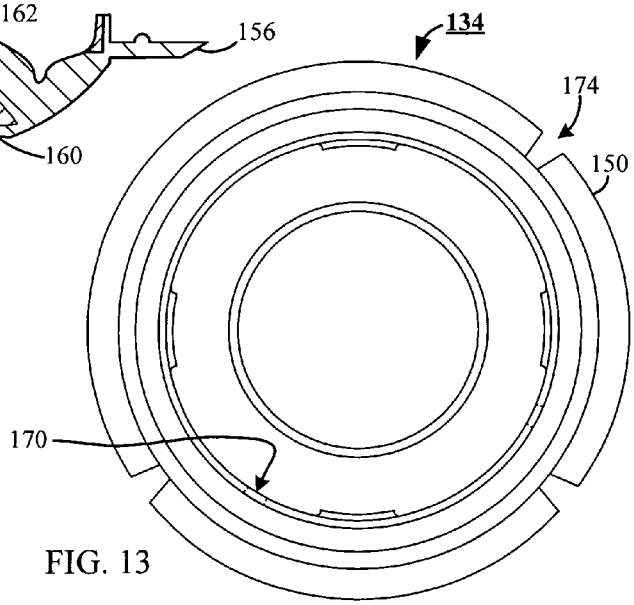
FIG. 13 shows a top plan view of the balance mass of FIG. 12.

FIG. 13 shows the inclusion of anti-roll notches 174 as an element of the embodiment of the balance mass 134 shown by FIG. 13, results in the tip lip portion 150 being a non-continuous member. The inclusion of the anti-roll notches 174 as an element of the tip lip portion 150 mitigates a potential tendency of the alternate container 130 (of FIG. 12) to roll on the tip engagement surface 156 (of FIG. 11) upon an inadvertent encountering of the tip engagement surface 156 with the container support surface 152 (of FIG. 12).

As will be apparent to those skilled in the art, a number of modifications could be made to the preferred embodiments which would not depart from the spirit or the scope of the present invention. While the presently preferred embodiments have been described for purposes of this disclosure, numerous changes and modifications will be apparent to those skilled in the art. Such changes and modifications are encompassed within the spirit of this invention.

What is claimed is:

1. A container comprising:

a bottom portion;

a side portion extending from the bottom portion, in which the side portion comprises an interior wall and an exterior wall, wherein the container directly contains a fluid adjacent the interior wall, and wherein the side portion provides a constant cross-sectional area along its entire length; and a balance mass, in which the balance mass comprises a core portion encapsulated by an encapsulant, and wherein the encapsulant is in pressing engagement with the exterior wall, and further wherein the encapsulant directly contacting the core portion forms a base region in contacting adjacency with a container support surface, and in which the encapsulant further comprises a side surface and a tip lip portion extending radially from the side surface at a proximal end, the tip lip offset from the container support surface and providing a ridge interposed mid-way between the proximal end and a distal end of the tip lip, wherein the tip lip portion mitigates an inadvertent engagement of the side portion with the container support surface supporting the base region.

2. The container of claim 1, in which a first density of the core portion is greater than a second density of the fluid.

3. The container of claim 1, in which a portion of the tip lip portion between the ridge and the proximal extent of the tip lip portion defines a channel.

4. The container of claim 3, in which the side surface of the balance mass further comprising an aperture extending from the channel and through the side portion of the balance mass.

5. The container of claim 4, in which the ridge is a condensate confinement ridge, the channel is a condensate collection channel, and the aperture is a condensate drain aperture.

6. The container of claim 1, in which the bottom portion comprises an inner surface and an outer surface, and wherein the balance mass is adjacent the outer surface.

7. The container of claim 6, in which the encapsulant further comprises a top surface adjacent the side surface and a bottom surface separated from the top surface by the side surface, wherein the top surface conforms to the outer surface of the bottom portion.

8. The container of claim 7, in which the container further comprising a spill angle defined as an angle between the side portion of the container and the container support surface, wherein upon encountering an angle greater than the spill angle, the side portion contacts the container support surface.

9. The container of claim 8, in which the tip lip portion further comprises a tip engagement surface on a distal portion of the tip lip portion, wherein upon encountering a tipping force sufficient to engender an angle greater than the spill angle, the tip engagement surface engages the container support surface to preclude contacting engagement of the side portion of the container with the container support surface, and the balance mass returns the side portion of the container to an upright position relative to the container support surface.

10. The container of claim 9, further comprising a lid portion offset from the bottom portion by the side portion, wherein the side portion has a predetermined overall length, and in which the tip lip portion is offset from the lid portion by a predetermined portion of the predetermined overall length of the side portion, and in which the spill angel is directly proportional to the mass of the core.

11. The container of claim 10, in which the tip lip portion forms a member of specific width at each predetermined portion of offset, wherein each predetermined portion of offset is directly proportional to a mass of the core, and wherein each specific width associated with each predetermined portion of offset is indirectly proportional to a mass of the core.

12. The container of claim 11, in which the member of specific width formed by the tip lip portion is a non-continuous member.

* * * * *